US010280905B2

(12) United States Patent
Eggler et al.

(10) Patent No.: US 10,280,905 B2
(45) Date of Patent: May 7, 2019

(54) PUMPING DEVICE FOR A WASTE HEAT RECOVERY APPARATUS IN A MOTOR VEHICLE

(71) Applicant: Mahle International GmbH, Stuttgart (DE)

(72) Inventors: Jochen Eggler, Waldburg (DE); Alfred Elsaesser, Keltern (DE); Helge Ladisch, Stuttgart (DE); Christian Maisch, Kirchheim (DE); Sascha Senjic, Stuttgart (DE)

(73) Assignee: Mahle International GmbH (DE)

( * ) Notice: Subject to any disclaimer, the term of this patent is extended or adjusted under 35 U.S.C. 154(b) by 0 days.

(21) Appl. No.: 15/514,289

(22) PCT Filed: Jul. 31, 2015

(86) PCT No.: PCT/EP2015/067696
§ 371 (c)(1),
(2) Date: Mar. 24, 2017

(87) PCT Pub. No.: WO2016/045841
PCT Pub. Date: Mar. 31, 2016

(65) Prior Publication Data

US 2017/0298911 A1 Oct. 19, 2017

(30) Foreign Application Priority Data

Sep. 25, 2014 (DE) ..... 10 2014 219 488

(51) Int. Cl.
*F04B 1/12* (2006.01)
*F04B 53/10* (2006.01)
(Continued)

(52) U.S. Cl.
CPC ..... *F04B 1/12* (2013.01); *F03C 1/06* (2013.01); *F04B 11/0091* (2013.01); *F04B 53/10* (2013.01)

(58) Field of Classification Search
CPC .. F04B 1/12; F04B 53/10; F04B 1/124; F04B 1/0413; F04B 1/0435; F02M 59/102
(Continued)

(56) References Cited

U.S. PATENT DOCUMENTS 3,411,453 A * 11/1968 Chanal ..... F04B 1/124 417/269
3,496,873 A 2/1970 Winter
(Continued)

FOREIGN PATENT DOCUMENTS

AT 264295 B 8/1968
AT 513999 A1 9/2014
(Continued)

OTHER PUBLICATIONS

English abstract for AT-513999.
(Continued)

*Primary Examiner* — Dominick L Plakkoottam
*Assistant Examiner* — Connor J Tremarche
(74) *Attorney, Agent, or Firm* — Fishman Stewart PLLC

(57) ABSTRACT

A pumping device may include a pump housing partially delimiting a working chamber, and a piston arranged therein, axially movable between first and second positions in which the working chamber has maximum and minimum volumes, respectively. The pumping device may include first and second fluid lines for introducing and discharging fluid to/from the working chamber, respectively. The first fluid line may be fluidically connected to the working chamber via a breakthrough formed in the pump housing at an end face of the working chamber opposite the piston, running
(Continued)

transversely to the axial direction at least in the area of the breakthrough. The second fluid line may open obliquely into the working chamber in an area of the second position, relative to the axial direction in an end face delimiting the working chamber towards the first fluid line.

20 Claims, 4 Drawing Sheets

(51) Int. Cl.
*F04B 11/00* (2006.01)
*F03C 1/06* (2006.01)

(58) Field of Classification Search
USPC ..... 417/437, 269
See application file for complete search history.

(56) References Cited

U.S. PATENT DOCUMENTS 4,486,152 A 12/1984 Porel
5,135,362 A * 8/1992 Martin ..... F04B 1/126 417/218
5,382,140 A * 1/1995 Eisenbacher ..... F04B 1/0413 417/273
5,701,873 A 12/1997 Schneider
6,866,025 B1 * 3/2005 Maass ..... F04B 1/0435 123/179.17
2010/0129246 A1 * 5/2010 Hopley ..... F02M 59/102 417/437
2015/0330482 A1 * 11/2015 Todd ..... F16H 7/0836 474/109

FOREIGN PATENT DOCUMENTS

CH 616208 A5 3/1980
CN 201277156 Y 7/2009
DE 3044363 A1 6/1981
EP 0476450 A1 3/1992

OTHER PUBLICATIONS

English abstract for CH-616208.
English abstract for CN-201277156.
English abstract for EP-0476450.

* cited by examiner

PUMPING DEVICE FOR A WASTE HEAT RECOVERY APPARATUS IN A MOTOR VEHICLE

CROSS-REFERENCE TO RELATED APPLICATION

This application claims priority to German Patent Application No. 10 2014 219 488.1, filed on Sep. 25, 2014, and International Patent Application No. PCT/EP2015/067696, filed Jul. 31, 2015, the contents of which are hereby incorporated by reference in their entirety.

TECHNICAL FIELD

The invention relates to a pumping device, in particular an axial piston pump, for a waste heat recovery apparatus in a motor vehicle.

BACKGROUND

Waste heat recovery devices are used for recovering energy from a waste heat flow of an internal combustion engine of a motor vehicle. Waste heat recovery devices known from the prior art typically comprise a fluid cycle, for example, a so-called Clausius-Rankine cycle in which a working fluid circulates. Mechanical energy is obtained from the heat stored in the working medium by various changes in state in the working fluid to which this is subjected when flowing through the fluid cycle.

Pumping devices are used for transporting the working fluid, which for example can be implemented in the form of a so-called stroke or axial piston pump. Such a stroke or axial piston pump follows the principle of action of a displacement pump in which the so-called displacer in the form of a piston executes a translational stroke movement within a working volume.

Against this background U.S. Pat. No. 3,412,453 A and U.S. Pat. No. 4,486,152 A each disclose a pumping device having a working chamber in which a piston is arranged adjustably. A first fluid line is used to introduce a fluid into the working chamber and is fluidically connected to the working chamber by means of a breakthrough arranged on an end face of the working chamber opposite the piston. A first valve element for closing the first fluid line with respect to the working chamber is arranged in the area of the breakthrough.

In addition, a second fluid line opens into the working chamber via which the fluid can again be discharged from the working chamber and specifically in the region of a position of the piston in which the working chamber has a minimal volume. A second valve element for closing the second fluid channel towards the working chamber is provided in the opening area of the second fluid line into the working chamber.

Cavitation effects which occur during the conveyance of the working fluid in the working volume frequently prove to be problematical in these stroke piston pumps. These typically result in a reduction in the amount of fluid conveyed by the pump within the stroke cycle. In extreme cases as a result of such cavitation, even individual components of the pumping device in contact with the working fluid such as, for example, valve elements or similar can be irreversibly damaged.

It is therefore an object of the present invention to provide an improved embodiment for a pumping device in which the said problems no longer occur or at most in severely restricted form.

The object is solved by the subject matter of the independent claim(s). Preferred embodiments are the subject matter of the dependent claims.

SUMMARY

The basic idea of the invention is accordingly to introduce the fluid to be conveyed by the pumping device from a fluid line into a working chamber of the pump which is fluidically connected to the working chamber at an end face of said working chamber. In this case, in relation to an axial direction along which a piston of the pumping device is adjustable in the working chamber, the end face lies opposite this piston. Said fluid line—hereinafter designated as "first fluid line"—is fluidically connected to the working chamber of the pumping device by means of a breakthrough provided in the pump housing of the pumping device.

It is essential to the invention that the arrangement of the first fluid line relative to the working chamber is in such a manner that it extends at least in the area of the breakthrough transversely to the axial direction. Experimental investigations have revealed that in this way flow losses in particular in the orifice area of the first fluid line can be reduced or even completely prevented. Since these flow losses and an associated falling below the vapour pressure in the working fluid are an essential cause of the occurrence of undesired cavitation, these cavitation effects can be prevented in this way. As a result, this leads to an improved conveying capacity and also to an increased lifetime of the pumping device.

A pumping device according to the invention comprises a working chamber which is delimited in part by a pump housing which can be filled in a known manner with a working fluid—hereinafter for simplicity designated as "fluid". A piston is arranged so that it can be moved along an axial direction in the working chamber forming the working volume. This piston can be moved along an axial direction between a first position in which the working chamber has a maximum volume and a second position in which the working chamber has a minimum volume. A first fluid line is used for introducing the fluid into the working chamber. Here the first fluid line is fluidically connected to the working chamber by means of a breakthrough which is formed in the pump housing at an end face of the working chamber opposite the piston. A first valve element for closing the first fluid line with respect to the working chamber is provided in the area of the breakthrough. The first fluid line runs transversely to the axial direction at least in the area of the breakthrough.

According to the invention, the second valve element communicates fluidically directly with the working chamber to avoid dead volumes. According to the invention, the second fluid line opens into the working chamber in an end facedelimiting the working chamber towards the first fluid line. In this way, the pumping device according to the invention can have a constructively particularly simple structure which is associated with reduced manufacturing costs.

In a preferred embodiment, the pumping device can comprise a fluid supply line for introducing the fluid into the first fluid line, which opens tangentially and/or obliquely into the first fluid line. Both measures, taken for themselves or in combination, have the result that the fluid can be introduced into the first fluid line without any defined deflection of the flow direction from the fluid supply line. Thus, undesired pressure losses in the fluid during introduction into the first fluid line and consequently also the formation of cavitation can be largely or even completely prevented.

Particularly little installation space is required by the pumping device according to the invention according to a further preferred embodiment in which the first fluid line extends in the area of the breakthrough in a plane perpendicular to the axial direction and is configured to be curved at least in the area of the breakthrough.

In a further preferred embodiment, the first fluid line is configured as a closed annular fluid channel which extends completely in the plane perpendicular to the axial direction. Such an annular geometry of the first fluid line has the result that the average transverse acceleration acting on the fluid during flow through the fluid channel can be kept relatively low. This measure also has the result that a pressure drop in the fluid caused by high transverse accelerations is largely avoided.

In another preferred embodiment, the first valve element projects at least partially from the first fluid channel through the breakthrough into the working chamber. This means that no additional fluid line needs to be provided between the first fluid line and the working chamber but that the fluid can be introduced directly from the—preferably annular—first fluid line into the working chamber of the pumping device. In this way, the amount of fluid to be accelerated during suction of the fluid into the working chamber is minimized, with the result that the already explained pressure drop of the fluid pressure, in this case caused by acceleration, can be reduced still further.

Particularly expediently the first valve element is a non-return valve which is adjustable between an open and a closed position, which is adjusted from the closed into the open position when the fluid pressure in the first fluid line is greater than in the working chamber and the pressure difference exceeds a predetermined threshold value. The use of such a constructively simply constructed non-return valve has the result that flow losses in the area of the valve element can be further reduced.

In order to discharge the fluid from the working chamber, in a further preferred embodiment it is proposed to fit the pumping device with a second fluid line for discharging the fluid from the working chamber. This preferably opens into the working chamber in the area of the second position of the piston. Similarly to the first fluid line, a valve element—hereinafter designated as "second valve element"—is provided for closure of the second fluid line in an opening area of the second fluid line into the working chamber.

In a further preferred embodiment, the opening area of the second fluid line is provided in an axial end section of the working chamber facing the first fluid line. This means that the two fluid lines open adjacently to one another into the working chamber of the pump. Thus, flow losses promoting the occurrence of cavitation can be restricted to a spatially limited area of the working chamber.

A further preferred embodiment in which the second fluid line opens into the working chamber in a circumferential side delimiting the working chamber and/or in an end face of the housing delimiting the working chamber towards the first fluid line has a constructively particularly simple structure and is thus associated with reduced manufacturing costs.

In a further preferred embodiment, the second valve element forms a part of the circumferential-side and/or end-face-side delimitation of the working chamber. Experimental tests have shown that such an arrangement particularly effectively counteracts cavitation effects.

Particularly expediently, the second valve element can end substantially flush with an end face and/or circumferential side delimiting the working chamber towards the first fluid line. An undesired recess promoting the formation of cavitation can in this way be largely or even completely avoided.

Experimental investigations and theoretical simulation calculations have shown that a particularly favourable flow pattern with regard to undesired cavitation formation can be produced in the working volume if the second fluid line opens obliquely into the working chamber relative to the axial direction.

According to a further preferred embodiment, the first fluid line is arranged in such a manner that the first fluid line extends or lengthens the working chamber along the axial direction.

Similarly to the first valve element, in a further preferred embodiment the second valve element can be a non-return valve which is adjustable between an open and a closed position. The second non-return valve is then adapted in such a manner that it is adjusted from the closed into the open position when the fluid pressure in the working chamber is greater than in the second fluid line and the pressure difference exceeds a predetermined threshold value. Accordingly, the second non-return valve can be reset into the closed position when the pressure difference again drops below said threshold value.

In another preferred embodiment, an orifice opening of the second fluid line into the working chamber can be arranged with regard to its axial position in such a manner that the piston specifically does not close this in its second position.

In a further preferred embodiment, the first valve element projects into the working chamber in such a manner that the remaining volume between the piston in its second position and the first valve element adopts a minimum value. This measure also counteracts undesired flow and compression losses of the fluid in the working volume.

In order to assist the introduction of fluid into the working chamber and the associated translational movement away from the opening of the first fluid line, a resilient element can be provided in the working chamber. This is preferably supported at one end on the first valve element and at the other end on the piston and thus pretensions the piston towards the first position.

If the conveying capacity desired in a specific application exceeds the conveying capacity which can actually be provided by the pumping device according to the invention, it is possible to set a plurality of pumping devices according to the invention in operative connection with one another and connect these fluidically in parallel to increase the conveying capacity. The invention therefore also relates to a pump arrangement comprising three previously introduced pumping devices according to the invention, whose working chambers are arranged with the breakthroughs between working chamber and first fluid line in each case parallel to one another in relation to the axial direction. The arrangement of the three working chambers with the breakthroughs between the first fluid line and the working chamber has a 120° rotational symmetry in a cross-section perpendicular to the axial direction in relation to a predefined symmetry point. Accordingly, the three first fluid lines are formed as a common annular fluid channel with the already-mentioned symmetry point as the annular centre point of the annular fluid channel. In this way, the installation space required for the three pumping devices can be kept small. The symmetrical structure of the three pumping devices also has the result that when three pumping devices are fluidically interconnected, the occurrence of undesired cavitation can be largely or completely avoided.

The invention finally relates to a waste heat recovery apparatus, comprising a fluid cycle through which a working medium—a fluid—flows or can flow. A pumping device according to the invention introduced above or a previously introduced pump arrangement according to the invention comprising three pumping devices is arranged in the fluid cycle for driving the working medium.

Further important features and advantages of the invention are obtained from the subclaims, from the drawings and from the relevant description of the figures with reference to the drawings.

It is understood that the features mentioned previously and to be explained further hereinafter can be used not only in the respectively given combination but also in other combinations or alone without departing from the scope of the present invention.

Preferred exemplary embodiments of the invention are presented in the drawings and are explained in detail in the following description, where the same reference numbers relate to the same or similar or functionally the same components.

DETAILED DESCRIPTION

Figure 1:
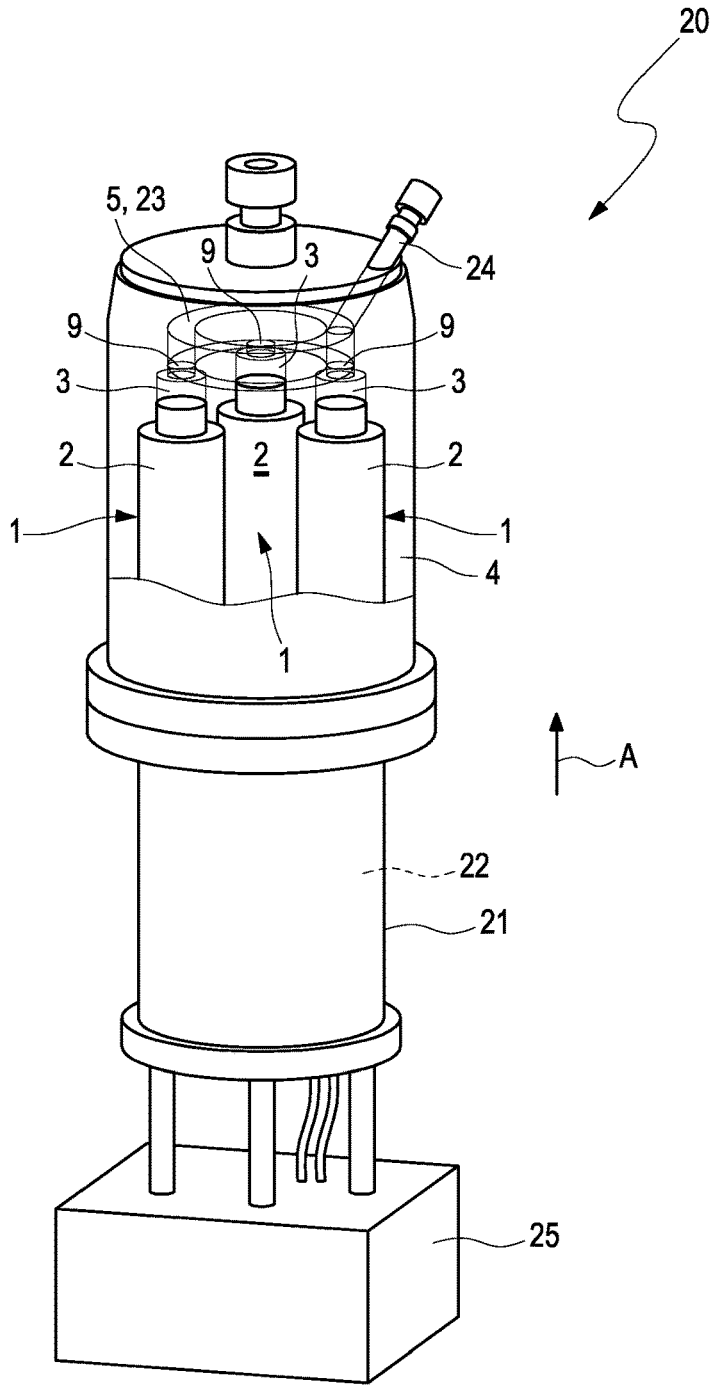
FIG. 1 shows an example of a pump arrangement according to the invention in a perspective view.
Figure 2:
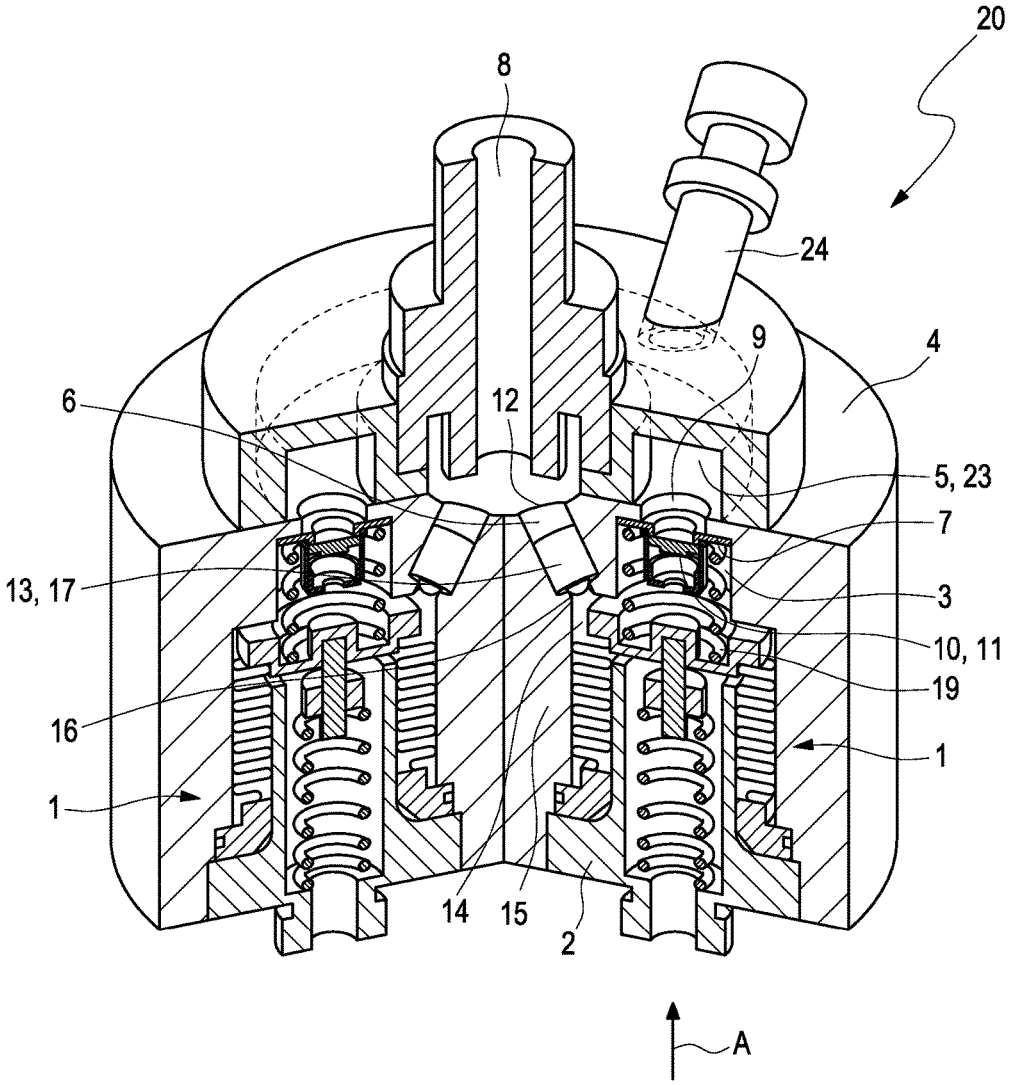
FIG. 2 shows a detailed view of FIG. 1 in which the structure of a pumping device 1 of the pump arrangement is shown in detail.
Figure 3:
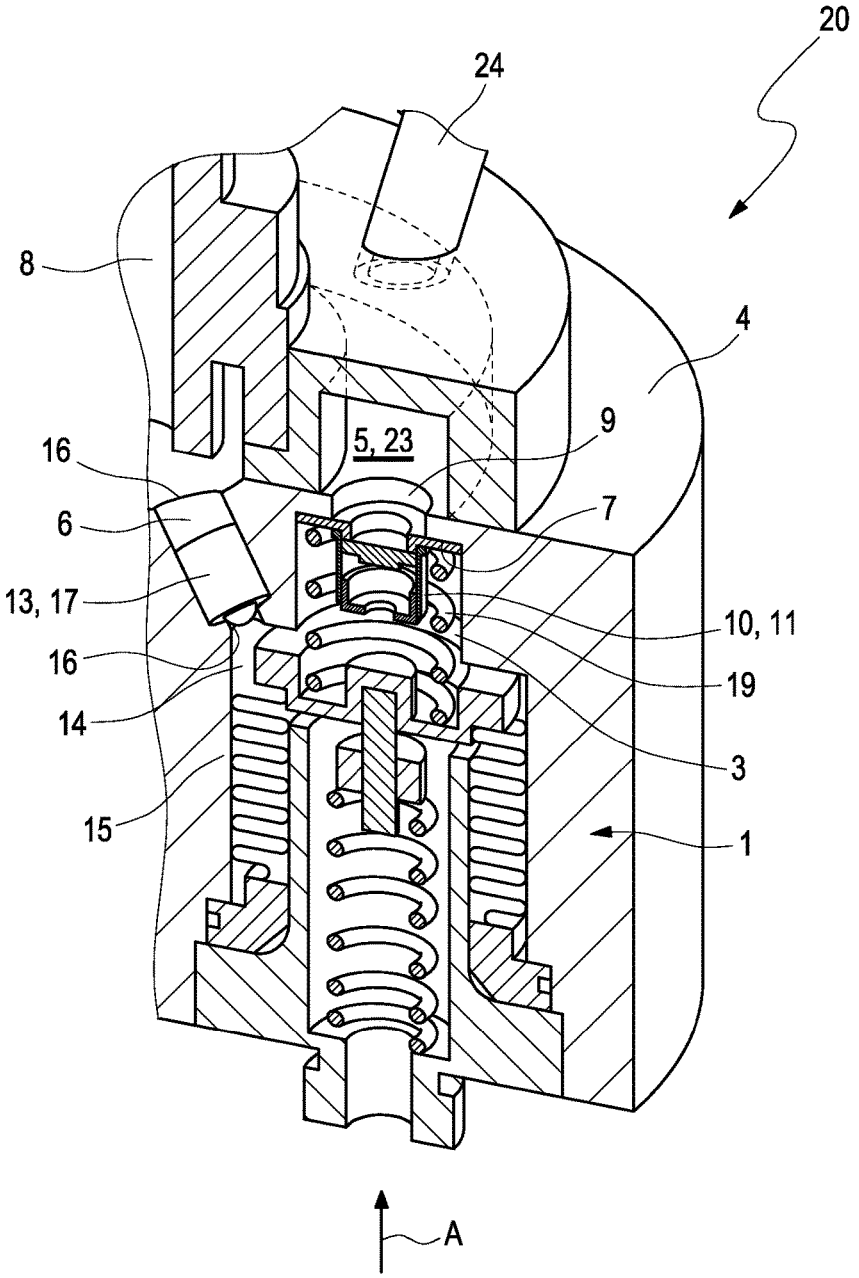
FIG. 3 shows a detailed view of the pumping device of FIG. 2 in the area of a working chamber 3 of the pumping device 1.

FIG. 1 illustrates in a perspective view an example of a pump arrangement 20 according to the invention. FIG. 2 shows a detailed view of FIG. 1 in which the structure of a pumping device 1 of the pump arrangement 20 is shown in detail. FIG. 3 in turn shows a detailed view of FIG. 2 in the area of a working chamber 3 of the pumping device 1.

The pump arrangement 20 comprises three pumping devices 1 each configured as stroke or axial piston pumps, which are implemented to form the pump arrangement 20 in the form of a tripod arrangement. This means that the respective pistons 2 of the three pumping devices 1 and the working chambers 3 accommodating the respective pistons 2, which are each delimited by a pump housing 4 are arranged parallel to one another in relation to their axial axis. A piston 2 which can be adjusted along an axial direction A is arranged in each of the three working chambers 3. Each of the three pistons 2 is adjustable axially between a first position in which the working chamber 3 has a maximum volume and a second position in which the working chamber 3 has a minimum volume. A common electric motor 22 which is arranged in a motor housing 21 which extends the pump housing 4 contrary to the axial direction A is used to adjust the three pistons 3. The electric motor 22 can be controlled with the aid of an electric/electronic control unit 25 which is fastened to this on a side of the motor housing 22 facing away axially from the pump housing 4.

The structure of one of the three pumping devices 1 is explained in detail hereinafter with reference to the diagram in FIG. 2.

The pump housing 4 together with the piston 2 delimits the working chamber 3 which can be filled with a fluid—the working medium of the pumping device 1. For this purpose the pumping device 1 has a first fluid line 5 which is fluidically connected to the working chamber 3 by means of a breakthrough 9. The breakthrough 9 is formed in the pump housing 4 on an end face 7 of the working chamber 3 opposite the piston 2. The first fluid line 5 runs in the area of the breakthrough 9 transversely to the axial direction A. In this case, the first fluid line 5 extends in the area of the breakthrough 9 in said plane perpendicular to the axial direction A.

In the example of the figures the first fluid line 5 is configured as a closed annular fluid channel 23 which extends completely in a plane perpendicular to the axial direction A. Consequently the first fluid line 5 is configured to be curved in the area of the breakthrough 9.

In the area of the breakthrough 9 a first valve element 10 for closing the first fluid line 5 is provided in the working chamber 3. In one variant the first valve element 10 can be arranged in the area of the breakthrough 9 also on the side of the first fluid line 5. The first valve element 10 in one variant can also project from the first fluid line 5 through the breakthrough 9 into the working chamber 3 and specifically in such a manner that the dead volume of the working chamber 3 is minimal or even has a zero value. Unnecessary dead volumes can also be avoided if the first valve element 10 communicates fluidically directly with the first fluid line 5, i.e. no intermediate space is formed between the first fluid line 5 and the first valve element 10.

The formation of undesired dead volumes can also be counteracted in the variant shown in the figures in which the first valve element 10 is arranged completely in the working chamber 3 and communicates fluidically via the breakthrough 9 directly, i.e. without forming an intermediate space, with the first fluid line 5.

In the example of the figures, the first valve element 10 is a non-return valve 11 which is adjustable between an open and a closed position. In the closed position the first valve element 10 closes the first fluid line 5 with respect to the working chamber 3 in a fluid-tight manner. In the open position the first valve element 10 releases the fluid communication between first fluid line 5 and the working chamber 3 so that the fluid can be introduced from the first fluid line 5 into the working chamber 3. The non-return valve 11 is adjusted from its closed position into its open position when the fluid pressure in the first fluid line 5 is greater than in the working chamber 3 and the pressure difference exceeds a predetermined value. This takes place by an axial movement of the piston 2 away from the breakthrough 9.

According to FIG. 2, the pumping device 1 also comprises a fluid supply line 24 for introducing the fluid into the first fluid line 5. According to FIG. 2, the first fluid line 5 extends the working chamber 3 along the axial direction A. The fluid supply line 24 opens tangentially into the first fluid line 5 configured as annular fluid channel 23. Alternatively or additionally the fluid supply line 24 can also open obliquely into the first fluid line 5. This can in particular mean that in a longitudinal section of the pumping device 1 along the axial direction A the fluid supply line 24 forms an acute angle with the plane perpendicular to the axial direction A in which the annular fluid channel 23 is arranged.

For discharging the fluid from the working chamber 3, a second fluid line 6 is provided which opens into the working chamber 3 in the area of the second position of the piston 2—this position is shown in FIG. 2 and also in the detailed view of FIG. 3. The opening area 12 of the second fluid line 6 is therefore—in the same way as the first fluid line 5 arranged on the front side—arranged in an axial end section 14 of the working chamber 3 facing the first fluid line 5. The second fluid line 6 opens into the working chamber 3 in a transition region between a circumferential wall 15 of the pump housing 4 delimiting the working chamber 3 and an end wall delimiting the pump housing 4 towards the first fluid line 5. The second fluid line 6 opens obliquely into the working chamber 3 relative to the axial direction A. An orifice opening 16 of the second fluid line 6 is arranged in relation to its axial position in such a manner that the piston 2 specifically does not close the orifice opening 16 in its second position.

Corresponding to the breakthrough 9 of the first fluid line 5, a second valve element 13 for optional fluid-tight closure of the second fluid line 6 with respect to the working chamber is also provided in the orifice area 12 of the second fluid line 6 into the working chamber 3. The second valve element 13, in the same way as the first valve element 10, is implemented as a non-return valve 17. In contrast to the first valve element 10 however it is adjusted from the closed into the open position when the fluid pressure in the working chamber 3 is greater than in the second fluid line and the pressure different exceeds a predetermined threshold value. This takes place if the piston 2 is moved along the axial direction A towards the breakthrough 9.

In the example of the figures, the second valve element 13 which is arranged in the transition region between circumferential-side and end-face-side delimitation of the working chamber 3, forms a part of the circumferential-side and end-face-side delimitation of the working chamber 3. Ideally the second valve element 13 ends substantially flush with the end face and/or circumferential side delimiting the working chamber 3 towards the first fluid line 5. An undesired recess promoting the formation of cavitation can in this way be largely or even completely avoided.

As shown in FIGS. 2 and 3, a resilient element 19 can be provided in the working chamber 3. This is supported according to FIG. 3 at one end on the first valve element 10 and at the other end on the piston 2 and thus pre-tensions the piston 2 towards the first position.

Figure 4:
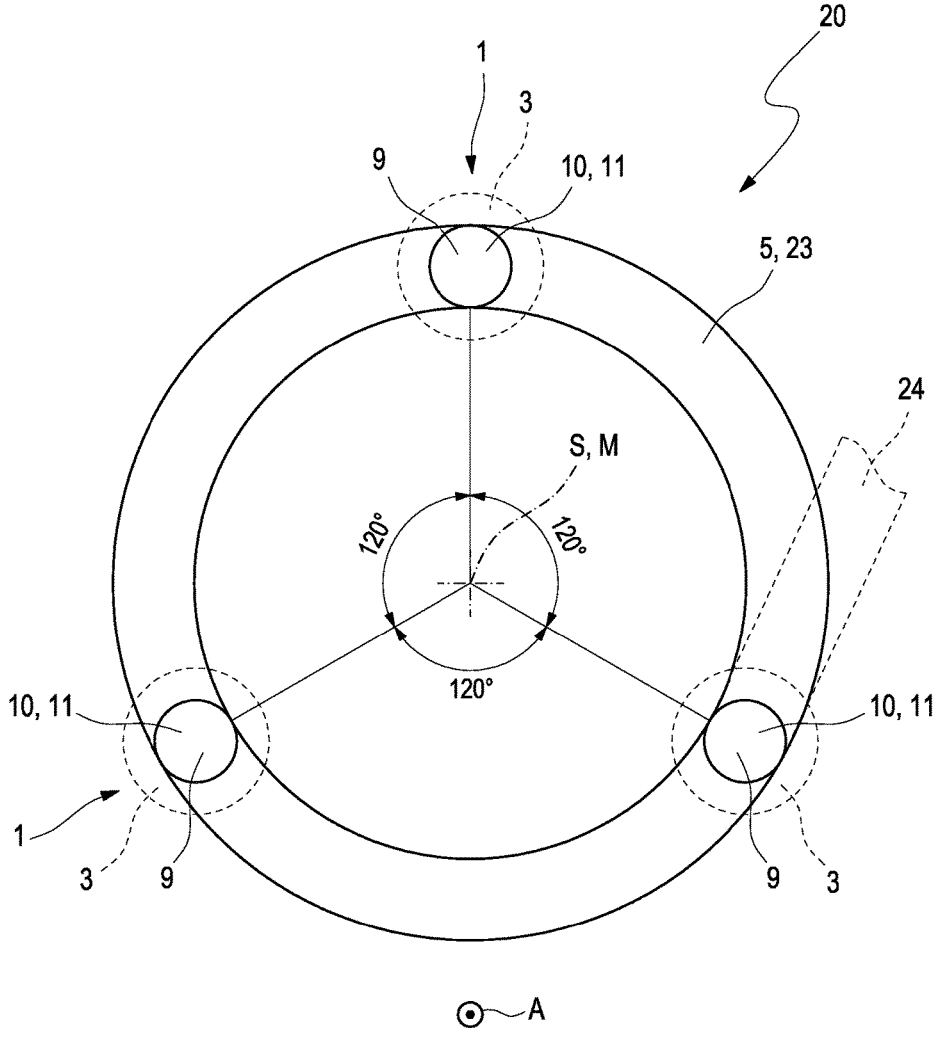
FIG. 4 shows a schematic view illustrating the tripod-like structure of the three pumping devices of FIG. 1 in schematic form.

Finally, the already-mentioned tripod-like arrangement of the pump arrangement 20 is explained with reference to FIG. 4. To this end, FIG. 4 shows the structure of FIG. 2 in a cross-section perpendicular to the axial direction A in a roughly schematic view. The three working chambers 3 of the three pumping device 1—indicated by dashed lines in FIG. 4—are arranged parallel to one another along the axial direction A. As FIG. 4 clearly confirms, the arrangement of the three working chambers 3 in the cross-section perpendicular to the axial direction A exhibits a 120° rotational symmetry in relation to a predefined symmetry point S. The three first fluid lines 5 here are formed as a common annular fluid channel 23 with the symmetry point S as annular central point M. The fluid channel 23 can be arranged in a plane perpendicular to the axial direction A.

In this way, the formation of the first fluid line 5 as an annular fluid channel 23 can be used to supply the working chambers 3 of all three pumping devices 1 with the working medium in the manner described above. This ensures that the formation of undesired cavitation both in the fluid channel 23 and in the three working chambers 3 can be largely or even completely prevented.

The three second fluid lines 6 open according to FIG. 2 into a common fluid discharge line 8.

The invention claimed is:

1. A pumping device for a waste heat recovery apparatus of a motor vehicle, comprising:

a pump housing partially delimiting a working chamber that is fillable with a fluid;

a piston arranged in the working chamber and movable along an axial direction between a first position where the working chamber has a maximum volume and a second position where the working chamber has a minimum volume;

a first fluid line for introducing the fluid into the working chamber;

the first fluid line fluidically connected to the working chamber via a breakthrough disposed in the pump housing at an end face of the working chamber opposite the piston;

a first valve element for a fluid-tight closure of the first fluid line with respect to the working chamber provided in an area of the breakthrough in the first fluid line;

wherein the first fluid line extends transversely to the axial direction at least in the area of the breakthrough;

a fluid supply line for introducing the fluid into the first fluid line, the fluid supply line arranged to open tangentially into the first fluid line, where, from a top view of the pumping device, a centerline of the fluid supply line is tangential to a centerline of the first fluid line;

a second fluid line for discharging the fluid from the working chamber, the second fluid line arranged to open into the working chamber in an area of the second position of the piston;

a second valve element for a fluid-tight closure of the second fluid line with respect to the working chamber provided in an opening area of the second fluid line into the working chamber;

wherein the second fluid line opens obliquely into the working chamber relative to the axial direction;

wherein the second valve element communicates fluidically with the working chamber directly without defining an intermediate space;

wherein the second fluid line opens into the working chamber in an axial end section of the working chamber towards the first fluid line;

wherein the pump housing includes a circumferential wall providing a circumferential-side delimitation of the working chamber and an end wall providing an end-face-side delimitation of the working chamber towards the first fluid line, and the second fluid line has an opening orifice disposed in at least one of the circumferential wall and the end wall;

wherein the second valve element is structured and arranged to open and close the opening orifice of the second fluid line and define part of at least one of the circumferential-side delimitation and the end-face-side delimitation; and wherein the first fluid supply line opens obliquely into the first fluid line.

2. The pumping device according to claim 1, wherein the first fluid line extends in the area of the breakthrough in a plane perpendicular to the axial direction and has a curved portion at least in the area of the breakthrough.

3. The pumping device according to claim 2, wherein the first fluid line is configured as a closed annular fluid channel that extends completely in the plane perpendicular to the axial direction.

4. The pumping device according to claim 1, wherein the first valve element projects at least partially from the first fluid channel through the breakthrough and into the working chamber.

5. The pumping device according to claim 1, wherein the first valve element is arranged completely in the working chamber and communicates fluidically via the breakthrough directly with the first fluid line.

6. The pumping device according to claim 1, wherein the first fluid line provides an extension of the working chamber along the axial direction.

7. The pumping device according to claim 1, wherein the first valve element is a non-return valve adjustable between an open position and a closed position, wherein the non-return valve is adjusted from the closed position into the open position when the fluid pressure in the first fluid line is greater than in the working chamber and the pressure difference between the fluid in the working chamber and the fluid in the first fluid line exceeds a predetermined threshold value.

8. The pumping device according to claim 1, wherein the first valve element is a non-return valve adjustable to open and close the breakthrough, and wherein the first valve element is arranged to communicate fluidically via the breakthrough directly with the first fluid line without defining an intermediate space.

9. The pumping device according to claim 1, wherein the opening orifice of the second fluid line is disposed in a transition region between the circumferential wall and the end wall, and wherein the second valve element defines part of the circumferential-side delimitation and the end-face-side delimitation of the working chamber.

10. The pumping device according to claim 1, wherein the second valve element ends substantially flush with the at least one of the circumferential wall and the end wall.

11. A pump arrangement, comprising:

a pump housing;

a plurality of pumping devices disposed in the pump housing, the plurality of pumping devices respectively including:

a working chamber at least partially delimited by the pump housing that is fillable with a fluid;

a piston arranged in the working chamber and movable along an axial direction between a first position where the working chamber has a maximum volume and a second position where the working chamber has a minimum volume;

a first fluid line for introducing the fluid into the working chamber;

a breakthrough disposed in the pump housing fluidically connecting the first fluid line to the working chamber, the breakthrough disposed in the pump housing at an end face of the working chamber opposite the piston, wherein the first fluid line extends transversely to the axial direction at least in an area of the breakthrough;

a first valve element for a fluid-tight closure of the first fluid line with respect to the working chamber provided in the area of the breakthrough in the first fluid line;

a fluid supply line for introducing the fluid into the first fluid line, the fluid supply line arranged to open tangentially into the first fluid line, where, from a top view of the pump arrangement, a centerline of the fluid supply line is tangential to a centerline of the first fluid line;

a second fluid line for discharging the fluid from the working chamber, the second fluid line arranged to open into the working chamber in an area of the second position of the piston, wherein the second fluid line opens obliquely into the working chamber relative to the axial direction;

a second valve element for a fluid-tight closure of the second fluid line with respect to the working chamber provided in an opening area of the second fluid line into the working chamber, the second valve element communicating fluidically with the working chamber directly without defining an intermediate space;

wherein the second fluid line opens into the working chamber at an axial end section of the working chamber towards the first fluid line;

wherein the working chambers of the plurality of pumping devices define an arrangement with each of the breakthroughs arranged parallel to one another in relation to the axial direction;

wherein the arrangement of the working chambers with the breakthroughs has a 120° rotational symmetry in a cross-section perpendicular to the axial direction in relation to a predefined symmetry point;

wherein the first fluid lines of the plurality of pumping devices define a common annular fluid channel with the predefined symmetry point providing an annular centre point of the annular fluid channel; and wherein the first fluid supply line opens obliquely into the first fluid line.

12. The pump arrangement according to claim 11, wherein the plurality of pumping devices includes three pumping devices.

13. The pump arrangement according to claim 11, wherein the working chambers of the plurality of pumping devices are respectively delimited by a circumferential wall of the pump housing providing a circumferential-side delimitation and an end wall of the pump housing providing an end-face-side delimitation towards the first fluid line; and wherein the second fluid line of at least one of the plurality of pumping devices has an opening orifice disposed in a transition region between the circumferential wall and the end wall, and the second valve element of the at least one of the plurality of pumping devices is structured and arranged to open and close the orifice opening and define part of the circumferential-side delimitation and the end-face-side delimitation.

14. The pump arrangement according to claim 13, wherein the second valve element of the at least one of the plurality of pumping devices ends substantially flush with at least one of the circumferential wall providing the circumferential-side delimitation and the end wall providing the end-face-side delimitation.

15. A waste heat recovery apparatus, comprising:

a fluid cycle for communicating a fluid flow;

a pumping device arranged for driving a fluid in the fluid cycle, the pumping device including:

a pump housing partially delimiting a working chamber that is fillable with a fluid;

a piston arranged in the working chamber and movable along an axial direction between a first position where the working chamber has a maximum volume and a second position where the working chamber has a minimum volume;

a first fluid line for introducing the fluid into the working chamber;

a breakthrough disposed in the pump housing fluidically connecting the first fluid line to the working chamber, the breakthrough disposed in the pump housing at an end face of the working chamber opposite the piston, wherein the first fluid line extends transversely to the axial direction at least in an area of the breakthrough;

a first valve element for a fluid-tight closure of the first fluid line with respect to the working chamber provided in the area of the breakthrough in the first fluid line;

a fluid supply line for introducing the fluid into the first fluid line, the fluid supply line arranged to open tangentially into the first fluid line, where, from a top view of the pumping device, a centerline of the fluid supply line is tangential to a centerline of the first fluid line;

a second fluid line for discharging the fluid from the working chamber, the second fluid line arranged to open into the working chamber in an area of the second position of the piston, wherein the second fluid line opens obliquely into the working chamber relative to the axial direction;

a second valve element for a fluid-tight closure of the second fluid line with respect to the working chamber provided in an opening area of the second fluid line into the working chamber, the second valve element communicating fluidically with the working chamber directly without defining an intermediate space;

a first resilient element and a second resilient element arranged in the working chamber, the first resilient element being supported at one end on the first valve element and configured to pre-tension the piston towards the first position, the second resilient element being arranged at an end of the working chamber opposite to the first valve element;

wherein the second fluid line opens into the working chamber at an axial end section of the working chamber towards the first fluid line;

wherein the first valve element is adjustable to open and close the breakthrough, and the first valve element is arranged to communicate fluidically via the breakthrough directly with the first fluid line without defining an intermediate space between the first valve element and the breakthrough; and wherein the first fluid supply line opens obliquely into the first fluid line.

16. The waste heat recovery apparatus according to claim 15, wherein the pumping device includes three pumping devices disposed in an arrangement such that the breakthrough of each of the three pumping devices are parallel to one another in relation to the axial direction.

17. The waste heat recovery apparatus according to claim 16, wherein the arrangement has a 120° rotational symmetry in a cross-section perpendicular to the axial direction in relation to a predefined symmetry point; and wherein the first fluid line of each of the three pumping devices define a common annular fluid channel with the symmetry point providing an annular centre point of the annular fluid channel.

18. The waste heat recovery apparatus according to claim 15, wherein the first fluid line extends in the area of the breakthrough in a plane perpendicular to the axial direction and has a curved portion at least in the area of the breakthrough.

19. The waste heat recovery apparatus according to claim 15, wherein the first valve element is arranged completely in the working chamber.

20. The waste heat recovery apparatus according to claim 15, wherein:

the first valve element and the second valve element are each adjustable between an open position and a closed position;

the first valve element is adjusted from the closed position into the open position when a fluid pressure in the first fluid line is greater than a fluid pressure in the working chamber and a pressure difference between the fluid pressure in the first fluid line and the fluid pressure in the working chamber exceeds a first predetermined threshold value; and the second valve element is adjusted from the closed position into the open position when the fluid pressure in the working chamber is greater than a fluid pressure in the second fluid line and a pressure difference between the fluid pressure in the working chamber and the fluid pressure in the second fluid line exceeds a second predetermined threshold value.

* * * * *